United States Patent [19]

Wang

[11] Patent Number: 4,829,625

[45] Date of Patent: May 16, 1989

[54] PORTABLE VACUUM CLEANER/AIR COMPRESSOR WITH LIGHT

[76] Inventor: Ta C. Wang, No. 269, Sec. 2, An Ho Rd., Tainan City, Taiwan

[21] Appl. No.: 111,824

[22] Filed: Oct. 23, 1987

[51] Int. Cl.[4] ..... A41L 5/24; B01D 47/02

[52] U.S. Cl. ..... 15/300 A; 15/330; 15/344

[58] Field of Search ..... 15/330, 344, 300 A

[56] References Cited

U.S. PATENT DOCUMENTS

| | | | |
|---|---|---|---|
| 2,594,456 | 4/1952 | Kroenlein | 15/300 A X |
| 4,636,230 | 1/1987 | Fan | 15/339 X |
| 4,656,687 | 4/1987 | Wei | 15/344 X |
| 4,718,140 | 1/1988 | Johnson | 15/344 X |

*Primary Examiner*—Chris K. Moore
*Attorney, Agent, or Firm*—Klein & Vibber

[57] ABSTRACT

A motor assembly including a motor, a shaft, a gear assembly and an air compressor, encompassed by a vacuum casing and an impeller housing encompassing a number of evenly spaced impellers and impeller casings, the impellers being driven by the shaft of the motor assembly and the air compressor being driven indirectly by the motor through the gear assembly. The motor assembly and the impeller housing and related parts fit in a cylindrical cavity of a body so as to provide suction; high volume, low pressure air compression; and low volume, high pressure air compression. The body has a handle with a light on its front end.

2 Claims, 6 Drawing Sheets

PORTABLE VACUUM CLEANER/AIR COMPRESSOR WITH LIGHT

BACKGROUND OF THE INVENTION

This invention relates to a combination air compressor and vacuum cleaner, and more specifically relates to a hand-carried combination air compressor and vacuum cleaner with a built-in flashlight.

In the past, small, portable vacuum cleaners for cars and outdoor uses and small, portable air compressors (especially for emergency kits and the like) and of course flashlights have been available to the public, but often caused problems with cluttering up the car with three separate articles. Also, since both the air compressor and the vacuum cleaner require an electric motor, costs are duplicated to a certain extent over the combination-type invention described in the detailed description. To many users, the initial expense of three separate articles outweighs the advantages of buying them all. Another major point is that it is difficult for the user to vacuum or to use air compressor at night because he or she can not see what he is doing without some type of light and it is difficult to handle a flashlight and a vacuum cleaner or air compressor at the same time.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a portable and non-cluttering device for vehicular and outdoor use in vacuuming or pumping air.

Another objective of this invention is to provide such a device with a built-in light for night use or for use in areas where light is not adequately accessible.

A further objective of this invention is to provide an air compressor with both a low and a high pressure air outlet.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
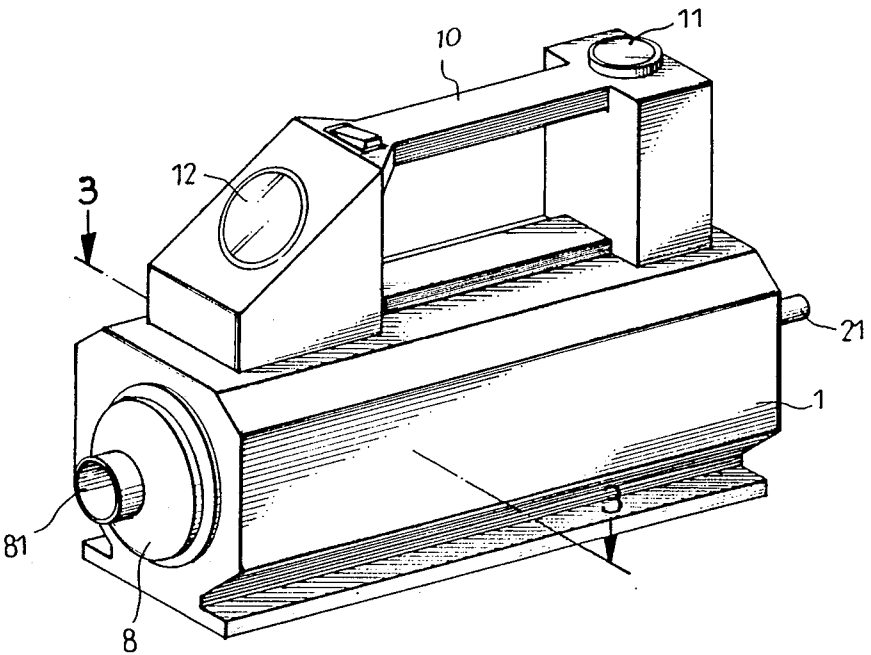
FIG. 1 is a perspective view of a portable vacuum cleaner/air compressor device with light in accordance with the present invention.

Referring to FIG. 1, it can be seen that the present invention comprises a body 1, an air intake cover 8 with an air intake nozzle 81 extending therethrough, an air outlet nozzle 21, a light 12, a pressure gauge 11 and a handle 10.

From FIGS. 2 through 6, the inner structure of the present invention can be clearly understood. A cylindrical vacuum casing 2 is fixed in the rear side of a substantially cylindrical cavity 13 which extends lengthwise all the way through the body 1 and receives most of the other parts of the invention. The cylindrical vacuum casing 2 has one open end and one end having an air exit 22 extending therefrom. The air outlet nozzle 21 fits into the air exit 22 so that low pressure air in the second (rear) end of the vacuum casing 2 is exhausted therefrom. The impeller housing 3 is frictionally secured against the inner wall of the front (left) side of the cylindrical cavity 13 with one end of the impeller housing 3 being open and the other end fitting in the open end of the vacuum casing 2. The end that fits in the open end of the vacuum casing 2 also has vents 31 thereon for exhausting low pressure air therefrom into the vacuum casing 2. A motor assembly 4, which includes a motor 40, a gear assembly 42, and an air compressor 43, is mounted on the inside end of the impeller housing 3 by screws, as can be understood best with reference to FIG. 2. The motor 40 drives the shaft 41 and the gear assembly 42, which in turn drives the air compressor 43. The shaft 41 has a plurality of impellers (multiple impellers) 5 fixed thereto and evenly spaced therealong, each impeller 5 having its own respective impeller casing 6. These casings 6 are frictionally retained on the inner cylindrical wall of the impeller housing 3.

Figure 2:
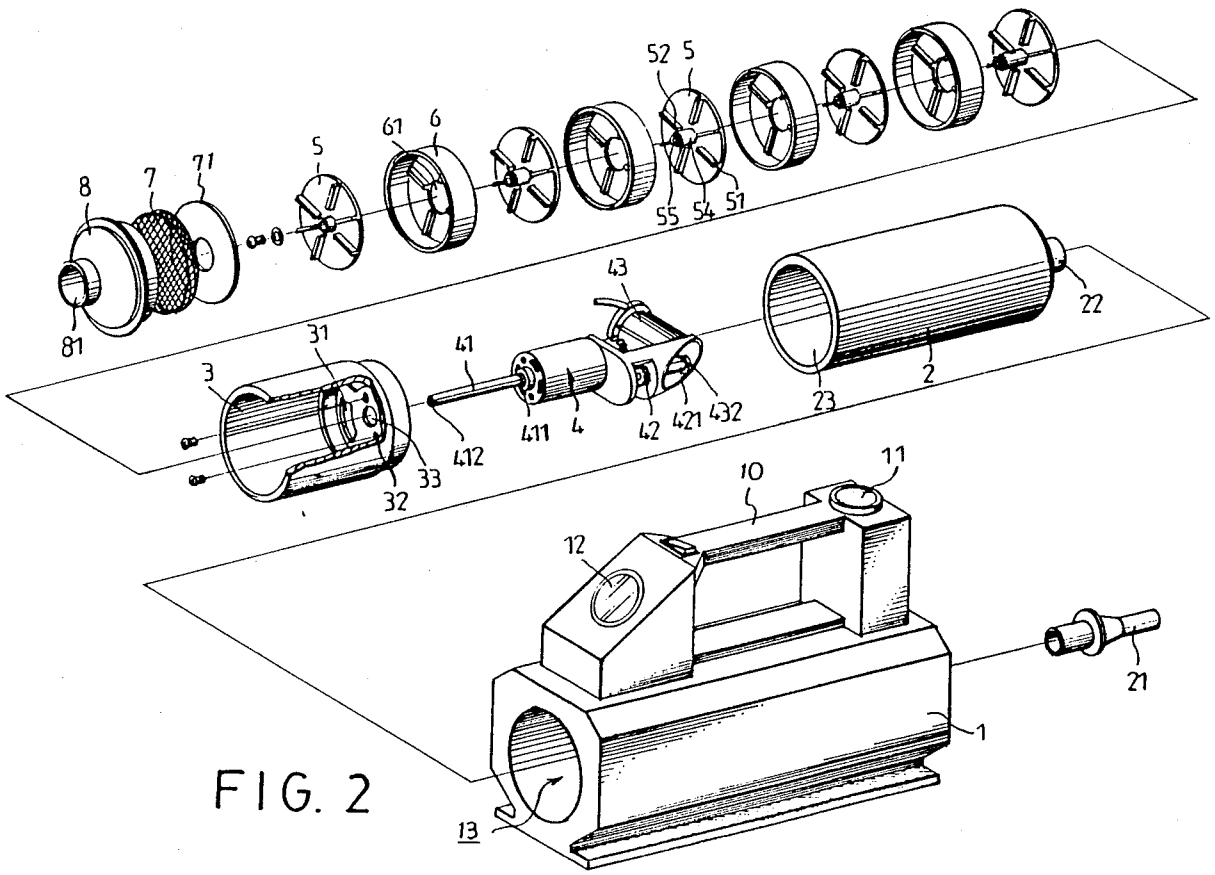
FIG. 2 is an exploded view of the device shown in FIG. 1.
Figure 3:
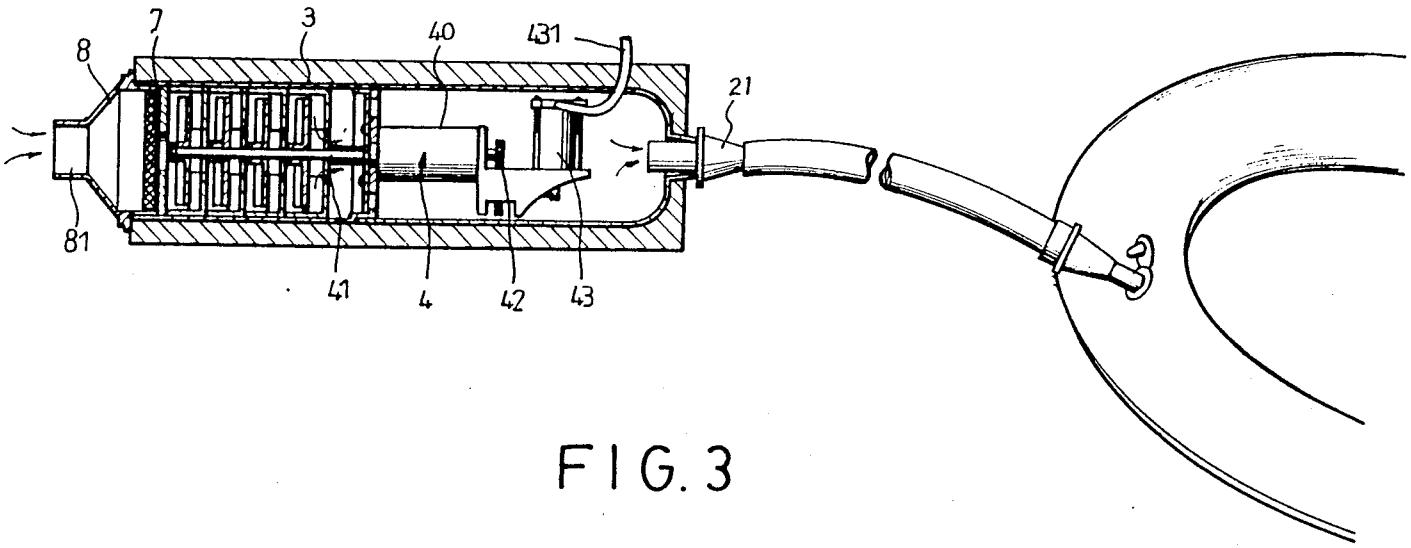
FIG. 3 is a cutaway working view of the device shown in FIG. 1 being used to blow up a raft-like article.

Referring now to FIGS. 2 and 3, it can be seen that a filter 7 and an air intake cover 8 fit on the front of the body, over the opening of the cylindrical cavity 13. The filter 7 fits between a circular plate 71 with a hole in the center thereof and the air intake cover 8. The air intake cover 8 secures at the open end of said impeller housing 3. Of course, the filter 7 keeps unwanted dust and particles out of the impeller housing 3 and motor assembly 4. FIG. 3 shows the present invention being used to inflate a raft or the like. Note that the air being used to inflate the raft is actually the exhaust air from the impeller casing, excluding the air which is pumped out of the high pressure hose 431 by the air compressor. Thus, both the high pressure hose 431 and the air outlet nozzle 21 are expelling air at the same time. In other words, high pressure air from said motor assembly 4 and low pressure exhaust air from said exhaust air nozzle 21 are continuously and simultaneously available whenever the motor is operating. The motor 40 drives the impellers 5 through the shaft 41 and the air compressor 43 through the gear assembly 42. Therefore, the user can pick which of the two air pumping functions he would like to use (high or low pressure).

Figure 4:
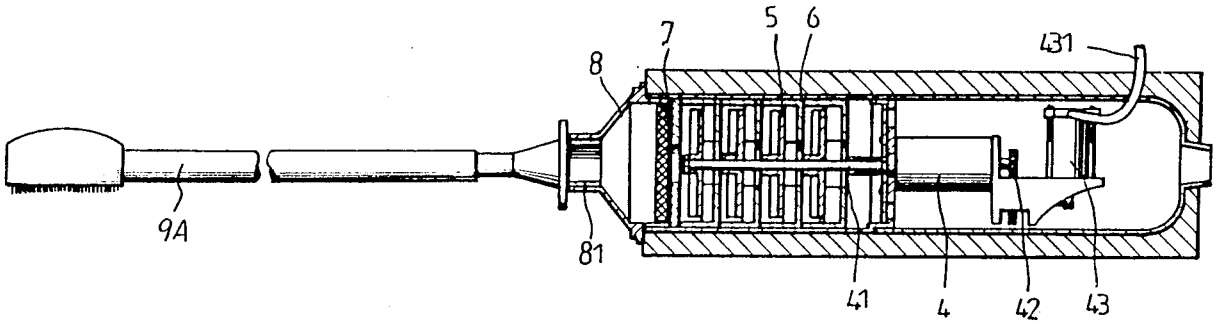
FIG. 4 is a cutaway working view of the device shown in FIG. 1 being used as a vacuum cleaner with brush attachment.
Figure 5:
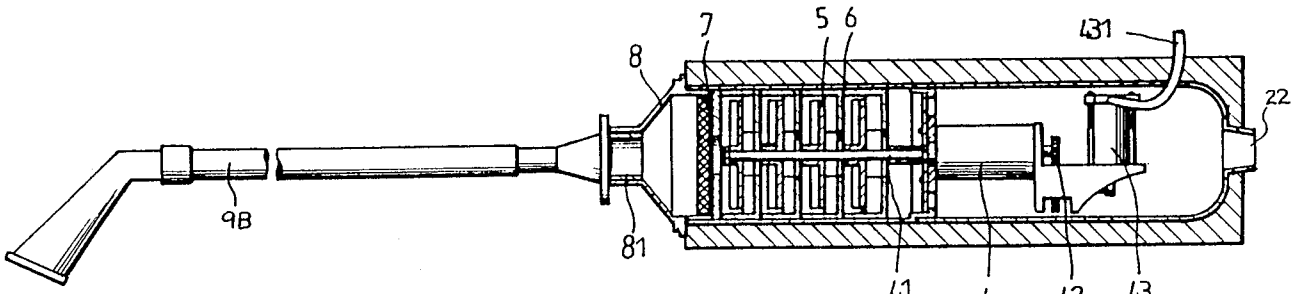
FIG. 5 is the same as FIG. 4, except with a nozzle attachment rather than a brush attachment.

FIGS. 4 and 5 shows that the present invention can also be used as a vacuum cleaner. A vacuum cleaner attachment 9 is simply engaged at the air intake nozzle 81 and then used as a normal vacuum cleaner. FIG. 4 shows the present invention being used with a brush vacuum attachment 9A and FIG. 5 shows the present invention being used with a nozzle vacuum attachment 9B. One especially convenient feature on the present invention is the light 12, which is set on the front end of the handle 10. When vacuumming in dark places or at night, the light 12 automatically lights the work area so as to insure proper cleaning. Of course, the light 12 could also be used when pumping air if necessary.

Figure 6:
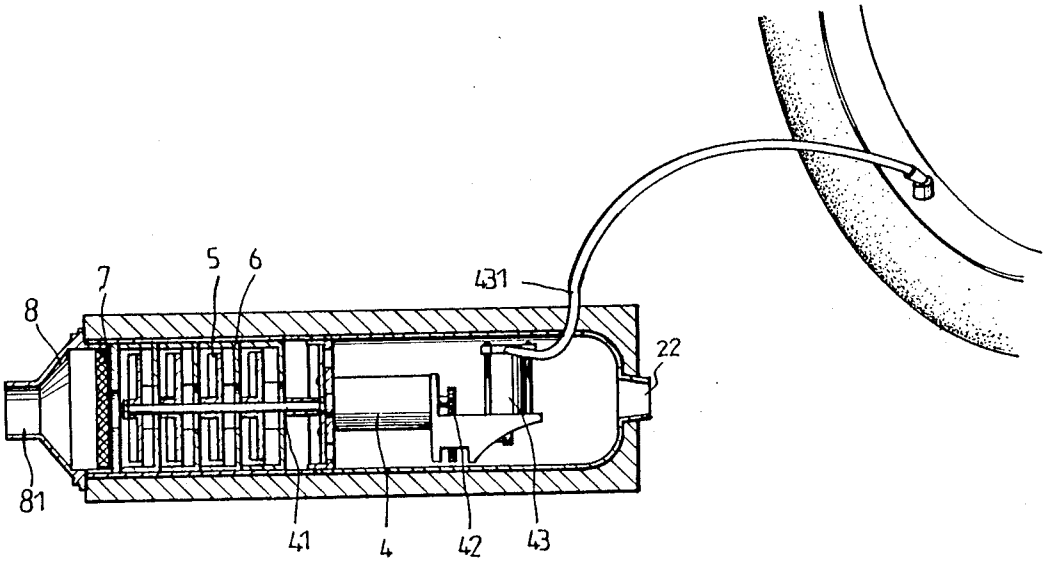
FIG. 6 is a cutaway working view of the device shown in FIG. 1, showing the use of the high pressure hose.

FIG. 6 shows the high pressure pumping feature of the present invention being used to blow up a tire. In this case, both the air intake nozzle 81 and the air exit 22 are free, that is, air moves freely through the cylindrical vacuum casing 2.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A portable vacuum cleaner/air compressor comprising the combination of:

(a) a body (1); said body (1) having a substantially cylindrical cavity (13) extending lengthwise therethrough; said body (1) also having a handle (10) thereon with a light (12) at a front end thereof;

(b) a cylindrical vacuum casing (2) with a first end and a second end; said first end being open and said second end having an air exit (22) extending therefrom; said cylindrical vacuum casing (2) being fixed in said cylindrical cavity (13);

(c) at least one impeller (5) being fixed on a shaft (41), an impeller housing (3) which is frictionally secured against an inner wall of said cylindrical cavity (13); one end of said impeller housing being open and a second end fitting in the open end of said vacuum casing; said second end of the impeller housing (3) also having vents (31) for exhausting low pressure air therefrom into said vacuum casing (2); said impeller housing housing (3) having at least one impeller casing (6) therein; said impeller (5) being encompassed by a respective impeller casing (6);

(d) a motor assembly (4) including a motor (40), said shaft (41), a gear assembly (42) and an air compressor (43) with a high pressure hose (431) connected thereto; said motor assembly being mounted on the second end of said impeller housing (3) with screws; said motor (40) driving both said shaft (41) and said gear assembly (42); said gear assembly (42) driving said air compressor (43); and (e) an air intake cover (8) with an air intake nozzle (81) extending therethrough; a filter (7) that fits between a circular plate (71) with a hole in the center thereof and said air intake cover (8); said air intake cover (8) securing at said open end of said impeller housing (3);

high pressure air from said motor assembly (4) and low pressure exhaust air from said air exit (22) being continuously and simultaneously available whenever said motor (40) is operating.

2. A portable vacuum cleaner/air compressor as claimed in claim 1 further comprising, said at least one impeller including a plurality of impellers fixed on said shaft (41), said at least one impeller casing including having a plurality of impeller casings (6); said multiple impellers (5) being encompassed by respective impeller casings (6).

* * * * *